US010006591B2

(12) United States Patent
Progl et al.

(10) Patent No.: US 10,006,591 B2
(45) Date of Patent: Jun. 26, 2018

(54) LED LAMP

(71) Applicant: Cree, Inc., Durham, NC (US)

(72) Inventors: Curt Progl, Raleigh, NC (US); Nick Hoang Nguyen, Durham, NC (US)

(73) Assignee: Cree, Inc., Durham, NC (US)

( * ) Notice: Subject to any disclaimer, the term of this patent is extended or adjusted under 35 U.S.C. 154(b) by 95 days.

(21) Appl. No.: 14/749,765

(22) Filed: Jun. 25, 2015

(65) Prior Publication Data

US 2016/0377235 A1 Dec. 29, 2016

(51) Int. Cl.

| | |
|---|---|
| ***F21K 99/00*** | (2016.01) |
| ***F21V 11/02*** | (2006.01) |
| ***F21V 19/00*** | (2006.01) |
| ***F21V 29/50*** | (2015.01) |
| ***F21V 23/00*** | (2015.01) |
| ***F21K 9/238*** | (2016.01) |
| *F21Y 101/02* | (2006.01) |

(52) U.S. Cl.

CPC ..... *F21K 9/1375* (2013.01); *F21K 9/238* (2016.08); *F21V 11/02* (2013.01); *F21V 19/003* (2013.01); *F21V 23/006* (2013.01); *F21V 29/50* (2015.01); *F21Y 2101/02* (2013.01)

(58) Field of Classification Search

CPC ..... F21V 29/50; F21V 29/83; F21V 29/004; F21V 29/74; F21V 29/773; F21V 29/70; F21V 11/02; F21V 11/06; F21V 19/003; F21V 19/004; F21V 19/001; F21V 19/0055; F21V 19/0025; F21V 23/006; F21V 23/06; F21K 9/1375; F21K 9/232; F21K 9/23; F21K 9/13; F21K 9/135; F21K 9/1355; F21K 9/233

USPC ..... 362/311.02, 294, 373, 646, 345, 218, 362/652, 655

See application file for complete search history.

(56) References Cited

U.S. PATENT DOCUMENTS

| | | | | |
|---|---|---|---|---|
| 4,503,360 | A * | 3/1985 | Bedel | H01J 61/34 313/19 |
| 5,537,301 | A * | 7/1996 | Martich | F21V 29/004 313/36 |
| 7,213,940 | B1 | 5/2007 | Van De Ven et al. | |
| 8,282,250 | B1 * | 10/2012 | Dassanayake | F21V 3/00 362/249.02 |
| 8,342,733 | B2 * | 1/2013 | Daily | H01R 12/721 362/249.01 |
| 8,430,528 | B2 * | 4/2013 | Yu | F21V 29/02 313/46 |

(Continued)

*Primary Examiner* — Anh Mai
*Assistant Examiner* — Arman B Fallahkhair
(74) *Attorney, Agent, or Firm* — Dennis J. Williamson; Moore & Van Allen PLLC

(57) ABSTRACT

The LED lamp has an enclosure defined by a housing and an optically transmissive exit surface. A base is connected to the enclosure. The housing is connected to the base at a proximal end and diverges as the housing extends away from the base to a distal end. The optically transmissive exit surface is connected to the distal end of the housing. A LED board is positioned transversely to a longitudinal axis of the enclosure adjacent the distal end to define a first interior space and a second interior space. A passage communicates the first interior space with the second interior space. A first aperture and a second aperture in the enclosure communicate the first interior space and the second interior space with the exterior of the lamp.

17 Claims, 12 Drawing Sheets

(56) References Cited

U.S. PATENT DOCUMENTS

| | | | | |
|---|---|---|---|---|
| 8,444,299 | B2 * | 5/2013 | Chou | F21V 29/004 165/80.3 |
| 8,525,395 | B2 * | 9/2013 | Muessli | F21V 29/004 313/46 |
| 8,596,821 | B2 * | 12/2013 | Brandes | F21K 9/238 362/249.01 |
| 8,967,837 | B2 * | 3/2015 | Tsuei | F21V 3/02 362/235 |
| 2011/0037368 | A1 * | 2/2011 | Huang | F21V 29/02 313/46 |
| 2011/0089838 | A1 * | 4/2011 | Pickard | F21V 29/767 315/113 |
| 2011/0273102 | A1 | 11/2011 | Van De Ven et al. | |
| 2012/0193647 | A1 | 8/2012 | Andrews | |
| 2013/0026923 | A1 | 1/2013 | Athalye et al. | |
| 2013/0026925 | A1 | 1/2013 | Ven et al. | |
| 2013/0069535 | A1 | 3/2013 | Athalye | |
| 2013/0069547 | A1 | 3/2013 | Van De Ven et al. | |
| 2013/0293135 | A1 | 3/2013 | Athalye | |
| 2013/0127353 | A1 | 5/2013 | Athalye et al. | |
| 2013/0162149 | A1 | 6/2013 | Van De Ven et al. | |
| 2013/0162153 | A1 | 6/2013 | Van De Ven et al. | |
| 2013/0169159 | A1 | 7/2013 | Lys | |
| 2013/0271981 | A1 * | 10/2013 | Hussell | F21V 7/00 362/235 |

* cited by examiner

LED LAMP

BACKGROUND

Light emitting diode (LED) lighting systems are becoming more prevalent as replacements for legacy lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver any color light, and generally contain no lead or mercury. A solid-state lighting system may take the form of a luminaire, lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

Since, ideally, an LED lamp designed as a replacement for a traditional incandescent or fluorescent light source needs to be self-contained; a power supply is included in the lamp structure along with the LEDs or LED packages and the optical components. A separate heatsink is also often needed to cool the LEDs and/or power supply in order to maintain appropriate operating temperature.

SUMMARY OF THE INVENTION

In some embodiments, a LED lamp comprises an enclosure including a housing and an optically transmissive exit surface and a base connected to the enclosure. The housing is connected to the base at a proximal end and diverges as the housing extends away from the base to a distal end to define an interior cavity. The optically transmissive exit surface is connected to the distal end of the housing. A LED board is positioned in the internal cavity and is oriented transversely to a longitudinal axis of the enclosure adjacent the distal end defining a first interior space and a second interior space. A passage communicates the first interior space with the second interior space. A LED on the LED board is operable to emit light when energized through an electrical path from the base. A first aperture in the enclosure communicates the first interior space with the exterior of the lamp.

In some embodiments, a LED lamp comprises an enclosure including a housing and an optically transmissive exit surface and a base connected to the enclosure. The housing extends from the base where the housing diverges as the housing extends away from the base to a distal end. The optically transmissive exit surface is positioned at the distal end of the housing. A LED board is adjacent the distal end and defines a first interior space and a second interior space between the LED board and the exit surface. A passage communicates the first interior space with the second interior space. A LED on the LED board is operable to emit light when energized through an electrical path from the base. A first aperture in the enclosure communicates the first interior space with the exterior of the lamp and a second aperture communicates the second interior space with the exterior of the lamp.

The first aperture may be positioned adjacent the base. The second aperture may be provided in the enclosure communicating the second interior space with the exterior of the lamp, the first aperture being spaced from the second aperture along the longitudinal axis of the lamp. The second aperture may be positioned in the housing or in the exit surface. A second aperture may be in the housing where the second aperture is spaced from the first aperture along the longitudinal axis of the lamp. The LED board may be thermally dissipative. The LED board may be electrically conductive. The LED board may form a part of the electrical path. The LED board may dissipate heat from the LED without a heat sink. The lamp electronics may be mounted to a lamp electronics board where the lamp electronics board may be electrically coupled to the LED board by a spring contact. The lamp electronics board may extend into the base.

DETAILED DESCRIPTION

Figure 1:
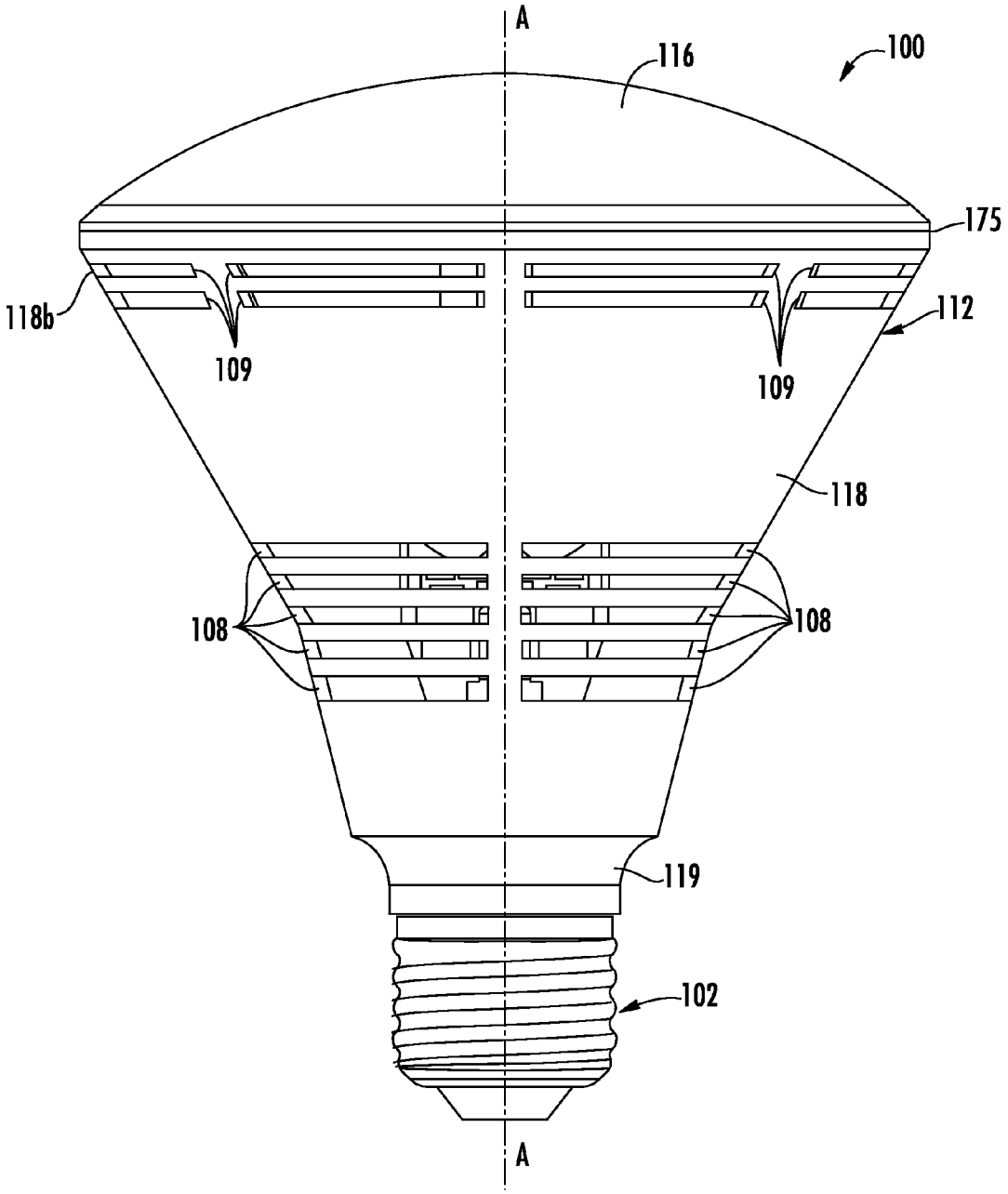
FIG. 1 is a plan view of an embodiment of a lamp of the invention.
Figure 2:
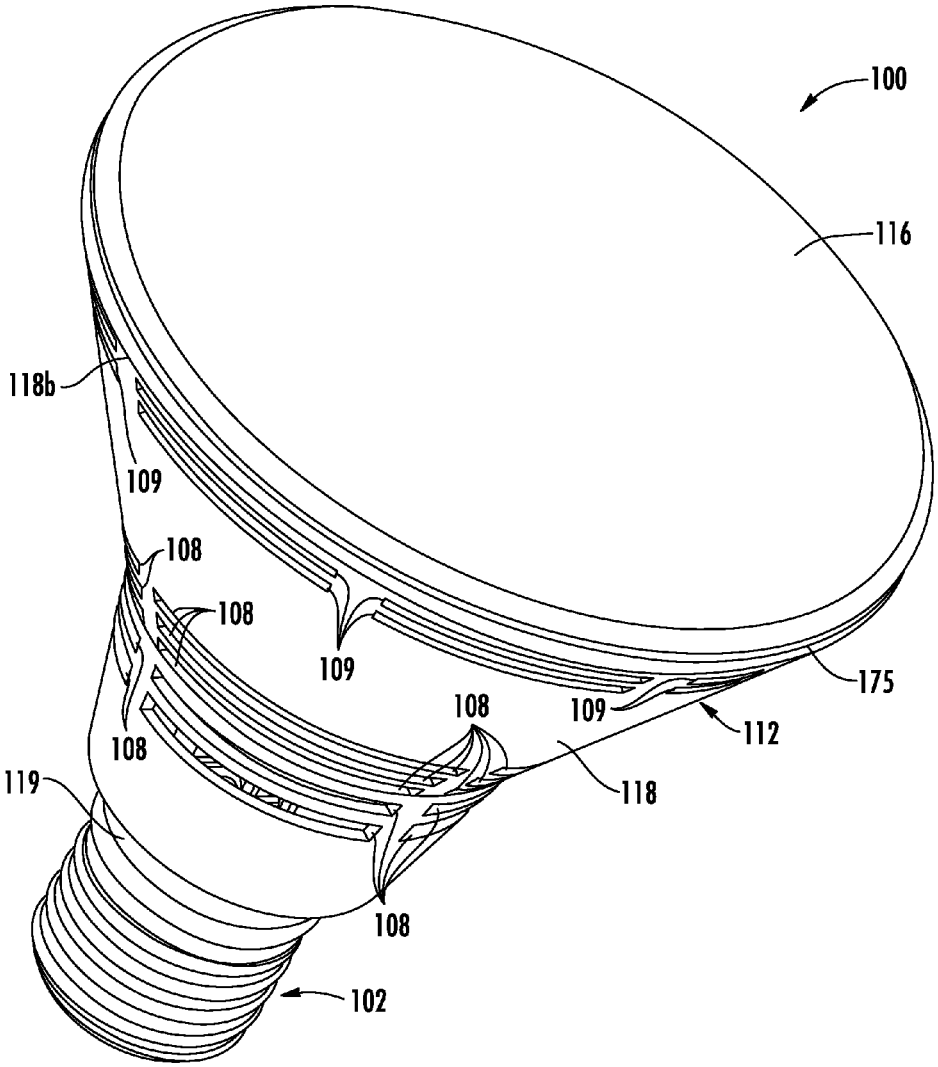
FIG. 2 is an isometric view of the lamp of FIG. 1.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

FIGS. 1-4 show a lamp, 100, according to some embodiments of the present invention embodied in a form factor of a traditional incandescent directional bulb. The lamp 100 may be dimensioned to be a replacement for a traditional BR-style lamp. In some embodiments, the lamp 100 is dimensioned such that the lamp falls within the ANSI standards for a BR series bulb. Traditional incandescent BR bulbs are reflector bulbs where an internal reflective surface of the enclosure reflects light generated by the light source such that the light beam is emitted from the bulb in a directional pattern; however, the beam angle is not tightly controlled and may be up to about 90-100 degrees or other fairly wide angles. The lamp of the invention comprises an enclosure 112 that has the form factor of a traditional directional bulb as shown in the drawings. The enclosure 112 comprises a housing 118 having a proximal end 118*a* comprising a neck 119 that is connected to a base 102. The housing 118 has a generally conical shape and diverges away from the neck 119 to an optically transmissive exit surface 116 at the distal end 118*b* thereof. The wall of the housing 118 in vertical cross-section may be flat or may be curved and from the proximal end 118*a* to the distal end 118*b* the transverse cross-section of the housing 118 has a generally circular shape that gradually increases in area. The housing 118 has a shape that is similar to the shape of the reflective housing in a traditional directional bulb; however, in the lamp of the invention the housing 118 is not used primarily to reflect light and is primarily used to house the internal lamp components such as the LED assembly 130 and lamp electronics 110 and to provide a cooling "chimney" for the LEDs as will be described. In some embodiments, the LED lamp may be equivalent to standard watt incandescent light bulbs such as, but not limited to, 40 Watt, 60 Watt, 100 Watt or other wattages.

Base 102 may comprise an Edison base 102 that is connected directly to enclosure 112. The base 102 comprises an electrically conductive Edison screw for connecting to an Edison socket. The lamp base, such as the Edison base 102, functions as the electrical connector to connect the lamp 100 to an electrical socket or other power source. Depending on the embodiment, other base configurations are possible to make the electrical connection such as other standard bases or non-standard bases. The base 102 may be connected to the enclosure 112 by adhesive, mechanical connector, welding, separate fasteners or the like.

A LED assembly 130, comprising LEDs 127, may be contained in the enclosure 112 such that light emitted by the LEDs 127 is transmitted to the exterior of the lamp with the desired beam angle. The enclosure 112 of directional lamp 100 may be partially optically transmissive where the enclosure comprises an optically transmissive exit surface or lens 116 and the opaque housing 118. The enclosure 112 may be made of glass, quartz, borosilicate, silicate, polycarbonate, ABS plastic, other plastic or other suitable material or combinations of such materials. In some embodiments, the exit surface 116 of the enclosure may be coated on the inside surface 116*a* with silica, providing a diffuse scattering layer that produces a more uniform far field pattern. The exit surface 116 may also be etched, frosted or coated to provide the diffuser. In other embodiments the exit surface 116 may be made of an optically transmissive plastic material such as polycarbonate or ABS plastic where the diffuser is created by the diffusive properties of the material itself. Alternatively, the diffuser may be omitted and a clear exit surface 116 may be provided. For breakable materials such as glass the enclosure 112 or portions of the enclosure 112 may also be provided with a shatter proof or shatter resistant coating. It should also be noted that in this or any of the embodiments shown here, the optically transmissive exit surface 116 or a portion of the optically transmissive exit surface could be coated or impregnated with phosphor or a diffuser.

In one embodiment, the enclosure 112 may be molded from a plastic material such as polycarbonate or ABS plastic. The exterior surface of exit surface 116 and/or the housing 118 of the enclosure may have a polished finish and in some embodiments may have a surface texture of VDI24 (VDI is a surface texturing scale from Verein Deutscher Ingenieure, the Society of German Engineers). While one specific surface texture index is provided, the surface may be manufactured to other standards where a smooth exterior surface of enclosure 112 is provided. Making the outer surface of the enclosure 112 with a polished finish creates a lamp that feels similar to a traditional glass and/or metal directional bulb. Because the enclosure 112 may be molded of plastic, the interior surface 116*a* of the exit surface 116 may be provided with a rougher texture than the exterior surface to provide mechanical diffusing of the light emitted from the lamp. In addition to the mechanical diffusion created by the textured interior surface 116*a* of the exit surface 116 the material or mixtures of the material of the exit surface 116 may be selected to provide material diffusion. The amount of texturing and the material of the surface of the exit surface 116 may be selected to vary the diffusive properties of the exit surface 116 and create varying light patterns. The different surface texturing of the inner and outer surfaces of the enclosure may be provided in a single molding operation by varying the surface texture of the mold cavity as compared to the mold core. In the housing portion 118 of the enclosure 112 that is not the exit surface 116 the enclosure may be made opaque rather than diffusive or transparent such that the enclosure has the visual appearance of a traditional directional lamp.

In one embodiment the enclosure 112 extends to and is connected directly to base 102. By extending the enclosure 112 to the electrically conductive base 102 the lamp has the look and feel of a traditional incandescent directional bulb that typically has a glass and/or metal bulb attached directly to an Edison screw. The housing 118 that surrounds the lamp electronics 110 may be provided with even greater surface texturing than the light transmissive exit surface 116 of the enclosure 112, it may be made of an opaque material, or it may be covered such as by paint or a film layer to prevent a person from viewing the internal structure of the lamp through the housing 118 from the exterior of the lamp.

In some embodiments the enclosure 112 may be formed of two parts such as an exit surface part 116 and a housing part 118 that connect at a seam 175. In one embodiment the seam 175 divides the optically transmissive exit surface 116 from the opaque housing 118. In this manner separate molding techniques and materials may be used to create the different light transmitting properties of the exit surface 116 and housing 118. After the internal components of the lamp are positioned in the housing 118 the exit surface 116 may be attached to the housing at seam 175 to complete the enclosure 112. The enclosure parts may be secured together by any suitable connection mechanism such as adhesive, mechanical fasteners, welding, snap-fit connection or the like. In other embodiments the enclosure 112 may be made of a left side part and a right side part that connect along a longitudinal seam. Because the two parts of the enclosure may be made of molded plastic, the left part and right part may each comprise an optically transmissive exit surface portion and a non-optically transmissive housing portion. The LED assembly 130 may be located in a first part of the enclosure and the second part of the enclosure may be attached to the first part to trap the LED assembly in the enclosure 112. In some embodiments, more than two parts may be used where for example, the housing 118 may be formed of a left part and a right part and the exit surface 116 may be formed as a separate part that is attached to the assembled two-part housing.

The enclosure 112 and the Edison screw 103 define an internal cavity 107 for receiving the electronics 110 of the lamp including the power supply and/or drivers and the LED assembly 130. The lamp electronics 110 are electrically coupled to the Edison screw 103 such that an electrical connection may be made from the Edison screw 103 to the lamp electronics 110. The lamp electronics may be mounted on a printed circuit board such as lamp electronics board 111 which includes the power supply, including large capacitor and EMI components that are across the input AC line along with the driver circuitry as described herein. The electronics may be potted to protect and isolate the lamp electronics 110. In some embodiments, some smaller components of the power supply circuitry may reside with the LED assembly 130. The lamp electronics board 111 may be electrically coupled to the LED board 129 on which the LEDs 127 are mounted to complete the electrical path from the base 102 to the LEDs 127. The term "electrical path" can be used to refer to the entire electrical path to the LED's 127, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LEDs. Electrical conductors run between the LEDs 127 and the lamp base 102 to carry both sides of the supply to provide critical current to the LEDs 127 as will be described.

Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. Other embodiments are possible using different driver configurations or a boost supply at lower voltages.

In some embodiments the lamp electronics board 111 may be supported by the enclosure 112 at its lower end. For example, the lower end of enclosure 112 may include receptacles such as opposed channels 163 (FIG. 9) that receive the outer lower edges of the board 111 such that the board may be inserted into the channels and mechanically connected to and supported by the enclosure 112. The lamp electronics board 111 may also be connected to the enclosure using adhesive, separate mechanical connectors or the like. Various connection mechanisms may be used in various combinations.

The LED assembly 130 may be implemented using a printed circuit board ("PCB") or other similar component which may be referred to as an LED board 129 and at least one and, more typically, a plurality of LEDs 127. Multiple LEDs 127 can be used together, forming an LED array 128. The LEDs 127 can be mounted on or fixed within the lamp in various ways. The LEDs 127 in the LED array 128 include LEDs which may comprise an LED die or a plurality of LED dies disposed in an encapsulant such as silicone, and LEDs which may be encapsulated with a phosphor to provide local wavelength conversion. A wide variety of LEDs and combinations of LEDs may be used in the LED assembly 130 as described herein. The LEDs 127 of the LED array 128 are operable to emit light when energized through the electrical path. The LED board 129 may comprise a series of anodes and cathodes arranged in pairs for connection to the LEDs 127. A LED 127 containing at least one LED or LED package is secured to each anode and cathode pair where the LED spans the anode and cathode. The LEDs may be attached to the LED board by soldering. While specific embodiments of LEDs are described herein, a greater or fewer number of anode/cathode pairs and LEDs may be used and the specific placement of the LEDs 127 on LED board 129 may vary from that shown.

LEDs 127 used with embodiments of the invention can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

In some embodiments, the LED board 129 may comprise a PCB, such as FR4 board, Chem3 board, a metal core printed circuit board (MCPCB), or other similar structure. The LED board 129 comprises a thermally conductive material supported on a dielectric material or other electrically insulating material or materials. The thermally conductive area may be formed as part of the electrical path, such as traces, that connect the LEDs 127 to the lamp electronics board 111. In some embodiments a large area of the LED board 129 may be thermally conductive such that a large area of the entire LED assembly 130 acts as a heat dissipative element to transfer heat to the air in the enclosure 112. It will be appreciated that in a typical PCB the electrical connections may be formed as metal traces or conductors where the traces or conductors are made relatively small so as to cover as small of an area of the PCB as possible and still provide electrical connections to the components on the PCB. In the lamp of the invention the LED board 129 may be provided with thermally conductive material such as copper, aluminum or the like where the amount of metal or other thermally conductive material used is sufficient to conduct heat away from the LEDs 127 and dissipate the heat to the surrounding air during steady state operation of the lamp. The copper, aluminum, other metal or other thermally conductive material on the LED boards 129 may form part of the electrical path to the LEDs 127. If the LEDs require additional thermal dissipation, additional metal may be used. In some embodiments the electrically and thermally conductive material may form relatively small traces as is commonly done with PCBs but additional thermally conductive material may cover a relatively large area of the LED board as a component separate from the electrically conductive traces that form the electrical path to the LEDs if the LEDs require additional thermal dissipation. In embodiments using a LED board such as FR4 or MCPCB, the LED board has structural rigidity such that the board physically supports the LEDs 127 in position in the lamp and forms part of the electrical path to the LEDs 127.

In some embodiments the LED board may comprise a hybrid structure where a rigid substrate physically supports the LEDs 127 in position in the lamp and where the electrical connections to the lamp may be made with a separate electrically conductive component. Where the electrical connections are made using a device such as a flex circuit, lead frame, wires or the like that do not have sufficient structural rigidity to adequately support the LEDs 127 in position in the lamp, the electrical circuitry may be mounted on a structurally rigid substrate. For example, the LED board 129 may comprise a substrate made of a structurally rigid material having circuitry applied to the surface of the substrate such that the electrical connections to the LEDs 127 are provided by the circuitry. In some embodiments the electrical connections may be made using a flex circuit comprising a flexible layer of a dielectric material such as a plastic, polymeric, polyimide, polyester or other material to which a layer of copper or other electrically and thermally conductive material is applied such as by adhesive. Electrical traces are formed in the conductive layer of the electrically conductive material to form electrical pads for mounting the electrical components such as LEDs 127 to the LED board 111 and for creating the electrical path between the components. The conductive layer may be covered by a protective layer or layers. In other embodiments, a lead frame may be used to provide the electrical path to the LEDs 127 and may be made of an electrically conductive material such as copper, copper alloy, aluminum, steel, gold, silver, alloys of such metals, thermally conductive plastic or the like. Other electrical circuits may be used with the rigid substrate. The boards may be a single member or multiple members joined together. While in one embodiment the board may be a relatively thin planar member the board may have other shapes. In some embodiments, the LED board 129 comprises a substrate such as metal, for example steel or aluminum, where a circuit is mounted on the substrate for providing the electrical path to the LEDs 127. The substrate may comprise a thermally conductive material to dissipate heat from the LEDs 127. In these and in other embodiments, the metal layers of the circuitry may be made of a sufficient area to increase the heat dissipative properties of the lamp as previously described. Moreover, while specific combinations have been described the various components may be arranged in various combinations. For example, the flex circuit, lead frame or other electrical circuitry may be mounted on any of the substrates described herein or on any other suitable substrate.

Figure 9:
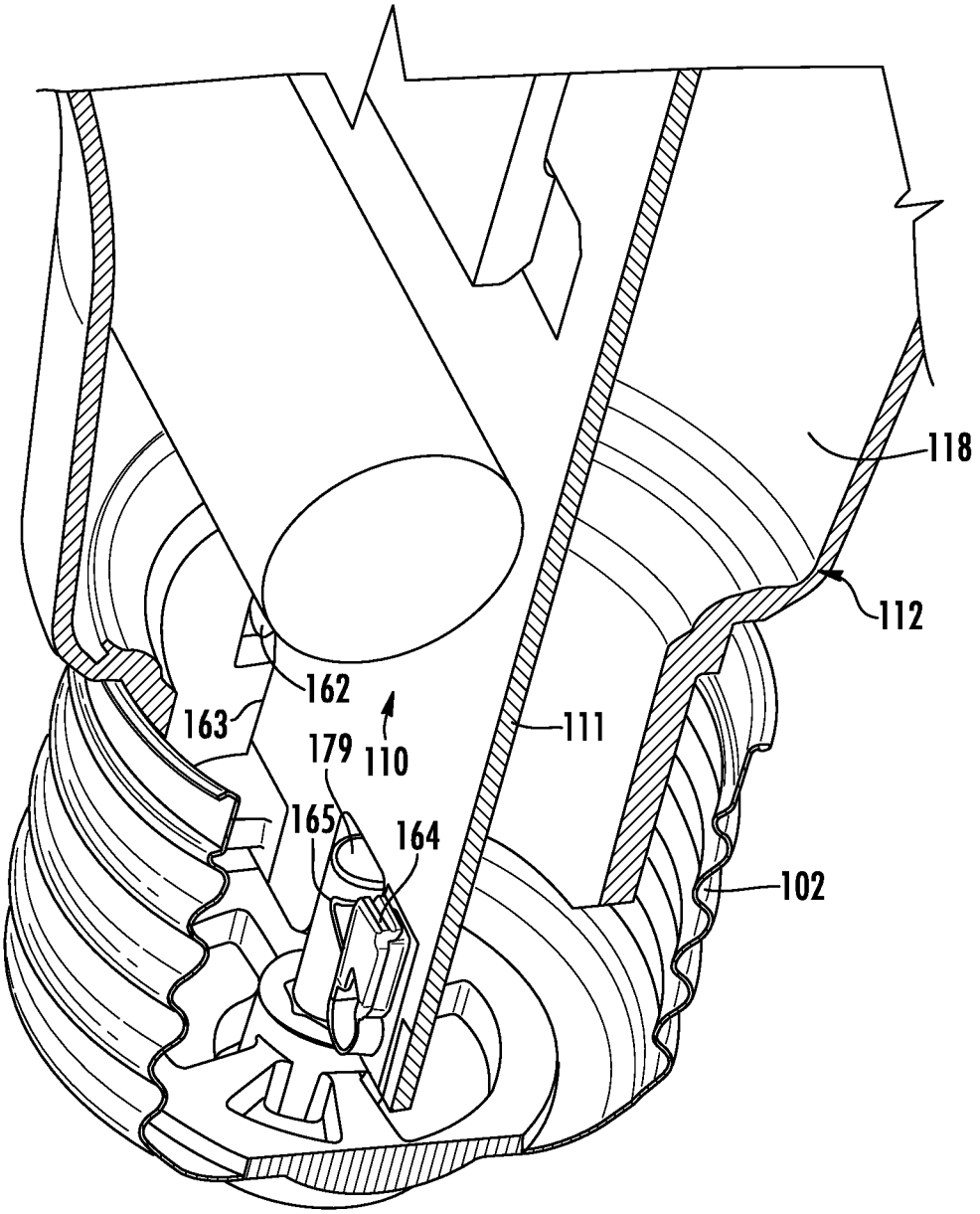
FIGS. 9 and 10 are section views of the connection between the lamp electronics board and base.
Figure 10:
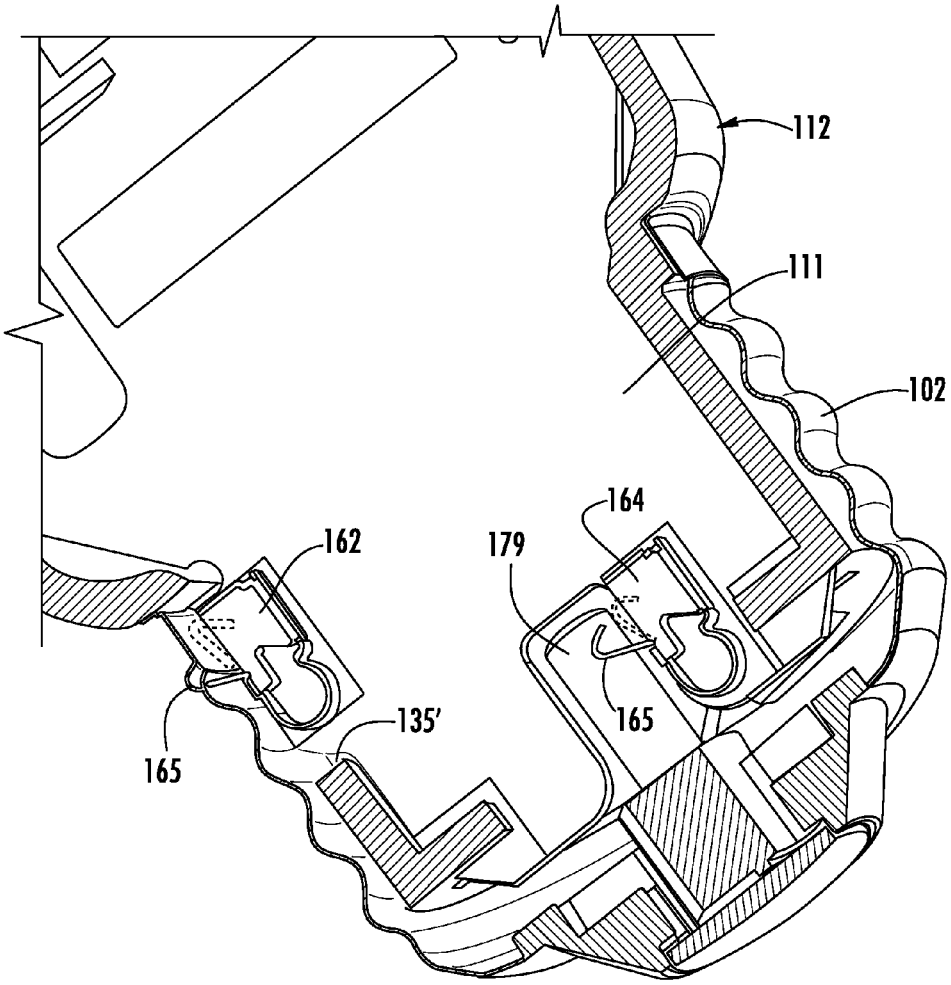

The electrical conductors on the LED board 129 may be connected to the electrical conductors on the lamp electronics board 111 to complete the electrical path between the LED board 129 and the lamp electronics board 111. To provide the electrical connection from the lamp base 102 to the LEDs 127 soldered and/or wired connections may be used between the conductive base 102 and the lamp electronics board 111 and between the lamp electronics board 111 and the LED board 129. In other embodiments spring contacts may be used such that the electrical connection between the base 102 and the lamp electronics board 111 and between the lamp electronics board 111 and the LED board 129 may be made without soldering or wires. Referring to FIGS. 9 and 10, the lamp electronics board 111 may comprise a first spring contact 162 that is electrically coupled to one of the anode or cathode side of the lamp electronics 110 and a second spring contact 164 that is electrically coupled to the other one of the anode or cathode side of the lamp electronics 110. The first spring contact 162 and the second spring contact 164 are arranged such that the contacts extend from the lamp electronics board 111. The spring contacts are configured such that they create an electrical connection to the anode side and the cathode side of the base 102. Where an Edison screw base 102 is used as shown in FIGS. 9 and 10 one spring contact 162 creates a contact coupling with the inside surface of the screw base 102 and the other spring contact 164 creates a contact coupling with the centerline contact 179. The contacts 162, 164 comprise resilient conductors 165 such that the conductors 165 are deformed (from the solid line position to the dashed line position as shown in FIG. 10) when the lamp electronics board 111 is inserted into the base 102 to ensure a good electrical contact with the base. The engagement between the spring contacts 162, 164 and the base 102 is a contact coupling where the electrical coupling is created by the contact under pressure between the contacts and the base 102 as distinguished from a soldered coupling and does not require separate wires or soldering.

While the electrical connection has been described with reference to an Edison base, the electrical connection as described herein may be used with any style of base, such as, but not limited to, single contact bayonet connectors, double contact bayonet connectors, pin connectors, wedge connectors or the like, where the spring contacts are configured to contact the electrical contacts of the base. It will be appreciated that the spring contacts and/or lamp electronics board 111 may be configured to conform to the shape, size and configuration of the base. Moreover, a greater or fewer number of contacts may be provided depending upon the configuration of the lamp electronics and/or the base contacts.

Figure 3:
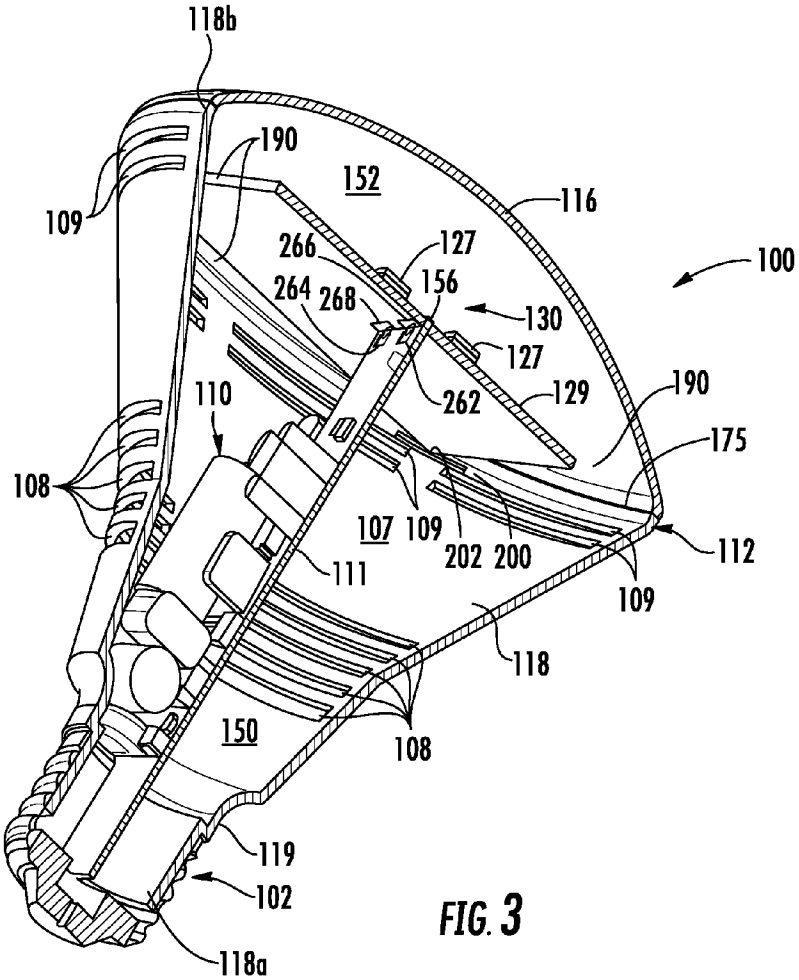
FIGS. 3 and 4 are section views of the lamp of FIG. 1.
Figure 4:
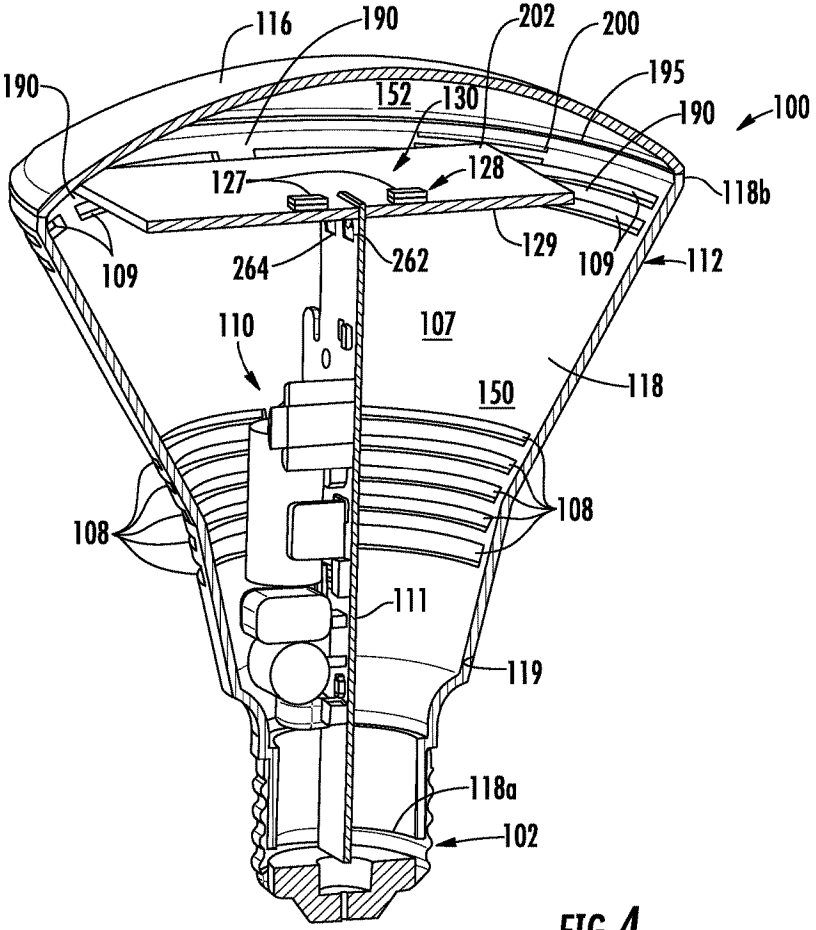

In some embodiments the LED board 129 may be electrically coupled to the lamp electronics board 111 using similar spring contacts to provide the electrical connection between the boards. Referring to FIGS. 3 and 4 one of LED board 129 and lamp electronics board 111 may be provided with spring contacts 262, 264. The other of the LED board 129 and the lamp electronics board 111 may be provided with electrical contacts such as pads 266, 268 that are coupled to the electronics on that board. Each of the spring contacts 262, 264 and pads 266, 268 are electrically coupled to one of the anode and cathode side of the electrical path. The pads 266, 268 are located and configured to make contact with the resilient conductors of the spring contacts 262, 264 when the boards are assembled. The contact of the pads 266, 268 with the resilient conductors of the spring contacts 262, 264 deforms the conductors to create a bias such that the conductors exert a force on the pads to maintain a good electrical coupling therebetween.

Figure 5:
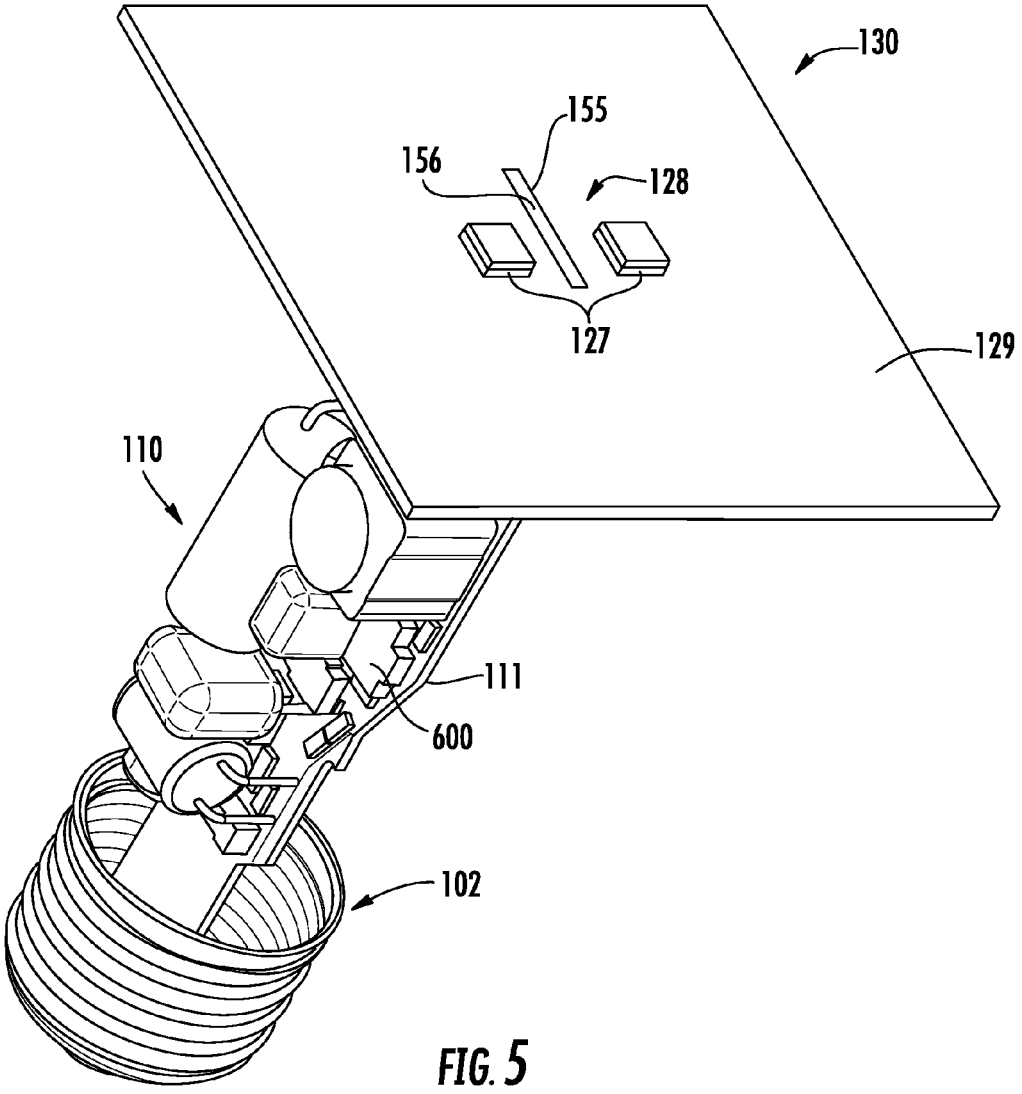
FIGS. 5 and 6 are perspective views of embodiments of an LED assembly and electronics board usable in the lamp of the invention.
Figure 6:
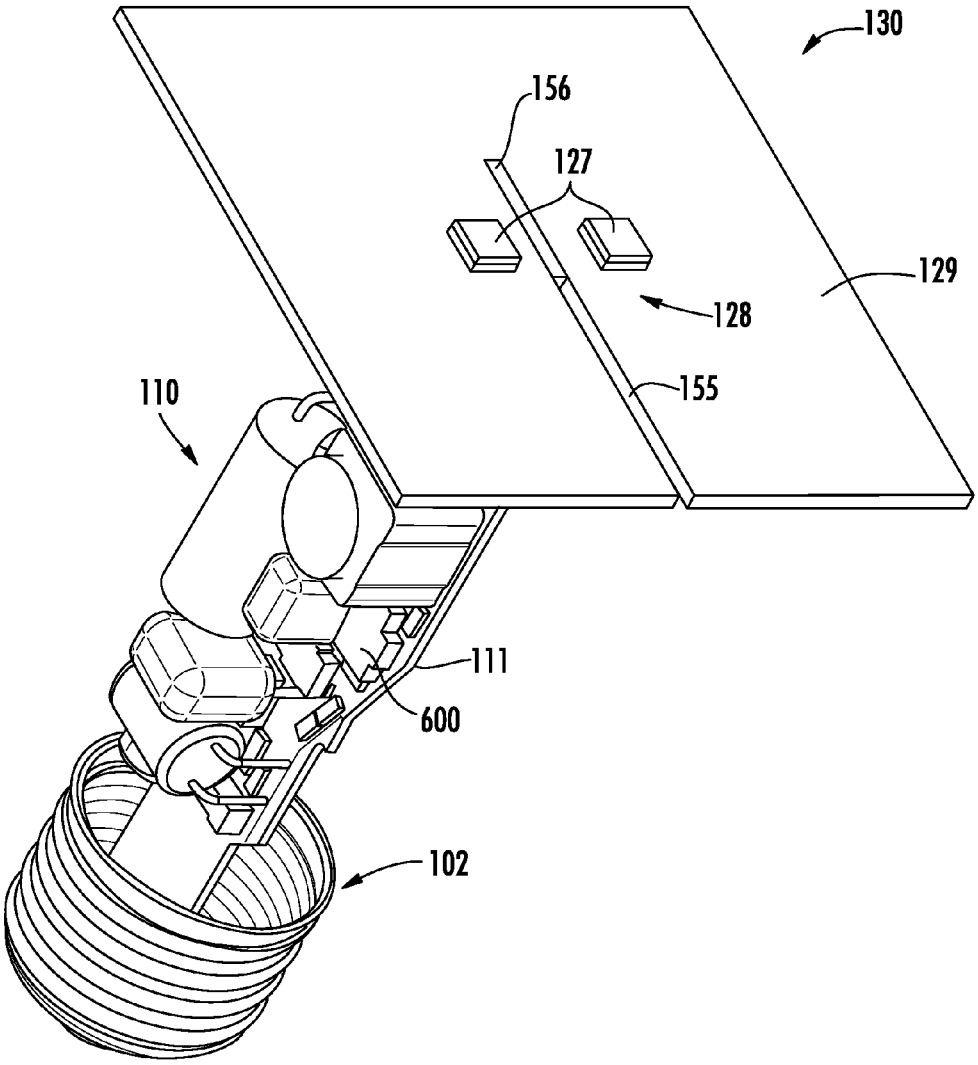

In one embodiment the LED assembly 130 may comprise a LED board 129 arranged perpendicularly to the longitudinal axis A-A of the lamp. The LEDs 127 may be mounted on the LED board 129 facing the exit surface 116 to create a desired light pattern. The LED board 129 may be arranged to divide the internal cavity 107 of the enclosure 112 into a first interior space 150 and a second interior space 152. The first interior space 150 extends from the LED board toward the proximal end 118*a* and the second interior space 152 extends between the LED board 129 and the exit surface 116. One of the LED board 129 and the lamp electronics board 111 may be formed with a slot 155 that receives a tab 156 formed on the other one of the LED board 129 and the lamp electronics board 111. The slot 155 may extend to an edge of the board (FIG. 6) or it may be formed as an aperture that extends through the board (FIG. 5). The engagement of the tab 156 with the slot 155 fixes and orients the boards relative to one another. When the boards 111, 129 are connected to one another the spring contacts 262, 264 complete the electrical connection between the boards.

Figure 7:
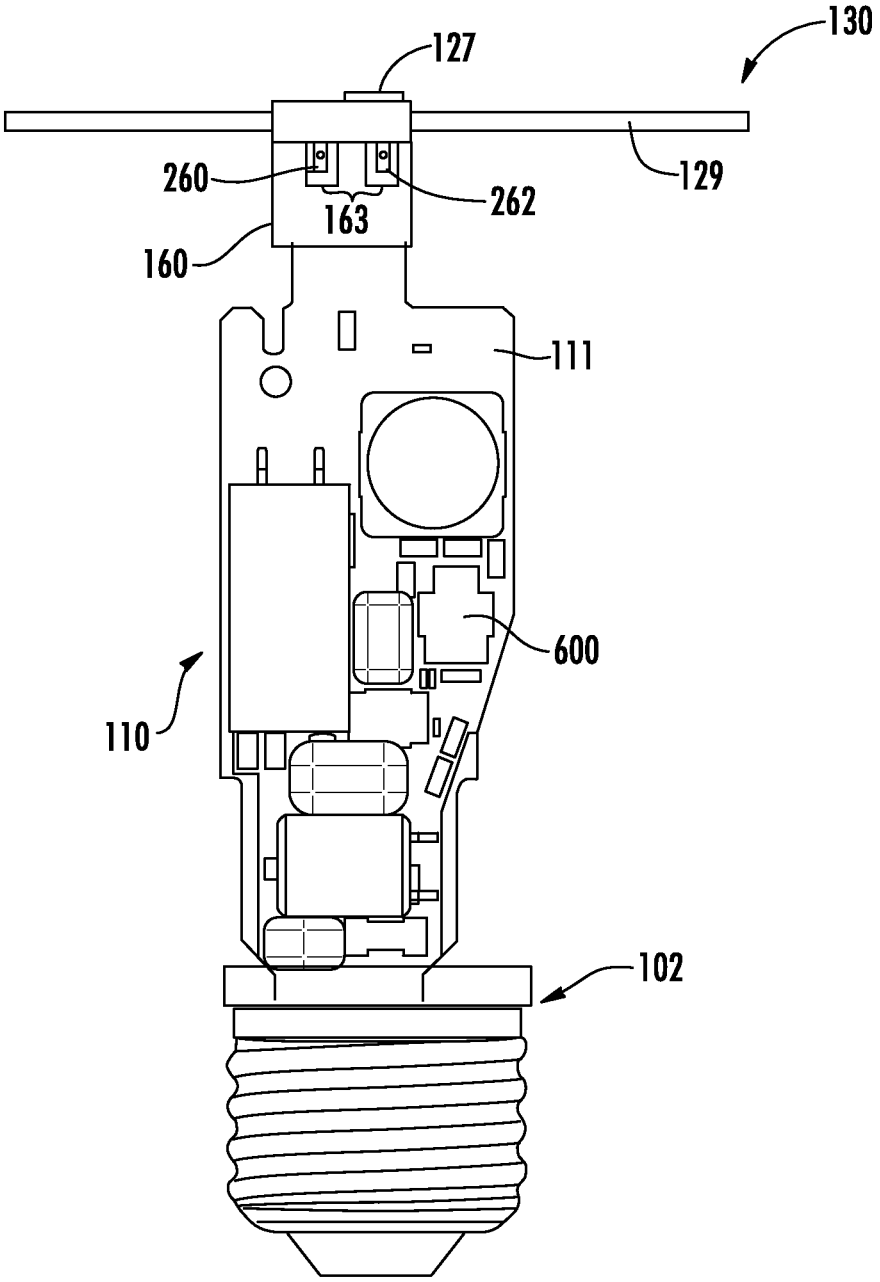
FIG. 7 is a side view of another embodiment of the LED assembly and electronics board usable in the lamp of the invention.
Figure 8:
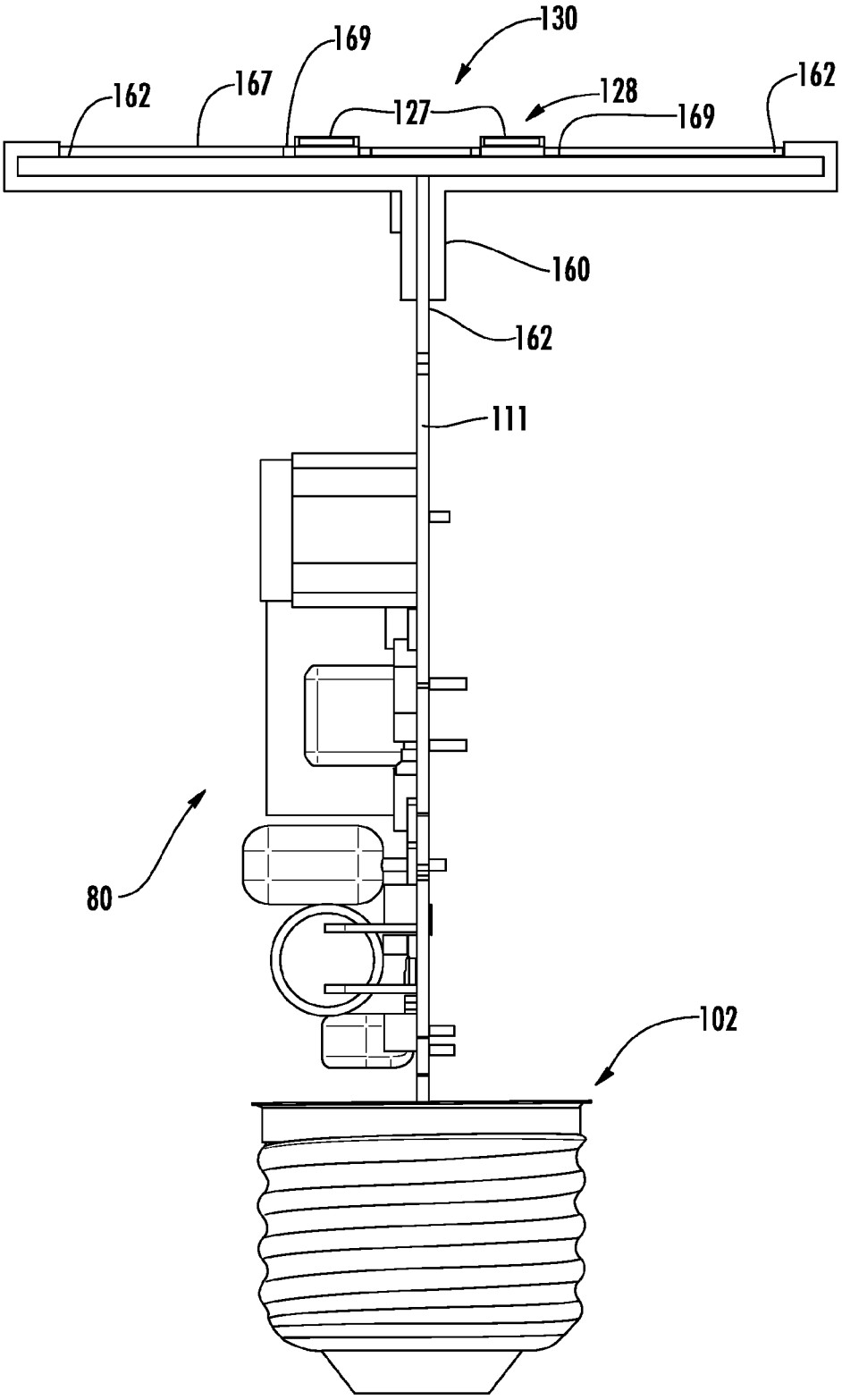
FIG. 8 is an end view of a LED board and lamp electronics board of FIG. 7.

In one embodiment the LED board 129 and the lamp electronics board 111 may be connected to one another using a reinforcement member 160 as shown in FIGS. 7 and 8. The reinforcement member 160 may comprise a molded plastic member. The reinforcement member 160 defines channels 162 that receive edges of the lamp electronics board 111 and LED board 129 to hold the boards in position relative to one another. The reinforcement member 160 may include apertures 163 to allow the spring contacts 262, 264 on one of the boards to engage the pads on the other board. In other embodiments, the reinforcement member 160 may include the spring contacts that make contact with electrical pads on both the LED board 129 and the lamp electronics board 111 such that the electrical connection between the boards is made through the electrical connector 160.

In one embodiment, the exposed surfaces of the LED assembly 130 may be made of or covered by a reflective surface, refractive optic surface, spreading surface and/or diffuse reflective surface 167, shown in FIG. 8, to reflect light from the enclosure 112 during operation of the lamp. The surface 167 may be a diffuse reflector and may be made of a white highly reflective material such as injection molded plastic, white optics, PET, MCPET, or other reflective material. Using a diffuse reflector the reflected light is reflected at many angles where an ideal diffuse reflector has equal luminance in all directions. A diffuse reflector scatters light to provide a uniform distribution of light. In some embodiments the surface 167 may be a specular reflector material such as injection molded plastic or die cast metal (aluminum, zinc, magnesium) with a specular coating. A reflective coating may also be applied via vacuum metallization or sputtering, and could be aluminum or silver. Using a specular reflector the reflected light is effectively reflected as a mirror of the source. The reflective surface may also be a formed film, formed aluminum, or the like. The reflective surface may also include a transparent matrix loaded with a high index material such as a silicone with TiO2 particles. One such suitable reflective material is shown and described in US Patent Application Pub. No. 2012/0193647, entitled "Solid State Lighting Component Package with Reflective Layer" by Andrews, having a Pub. Date of Aug. 2, 20112, which is incorporated by reference herein in its entirety. The entire LED assembly 130, other than the LEDs 127, may be made of or covered in the reflective surface, refractive optic surface, spreading surface and/or diffuse reflective surface 167 or portions of the LED assembly 130 may be made of or covered in the reflective surface, refractive optic surface, spreading surface and/or diffuse reflective surface 167. For example, portions of the LED assembly 130 that reflect light may be made of or covered in reflective surface, refractive optic surface, spreading surface and/or diffuse reflective surface 167 while the remainder of the LED assembly 130 may comprise other materials including non-reflective materials. The reflective surface 167 may be applied to the LED boards 129 with "cutouts" 169 provided to expose the LEDs 127. As used herein a "reflective surface" means a surface that reflects at least a major portion of the light from a light source whether the reflection is diffuse, Specular, spread or combinations of such reflections and includes surfaces that have refractive optical properties in addition to reflective properties.

The enclosure 112 may be provided with vent openings or apertures 108, 109 such that the interior of the lamp is in communication with the exterior of the lamp. The vent openings 108, 109 allow air to flow into, through and out of the enclosure 112 such that the air cools the LED assembly 130 and LEDs 127 inside of the enclosure. In one embodiment an aperture or plurality of apertures 108 are provided proximate to the base 102 and another aperture or plurality of apertures 109 are spaced from apertures 108 along the longitudinal axis A-A and are provided proximate to the distal end of the lamp such that air may flow through the enclosure 112 along the longitudinal axis of the lamp. The apertures 108 may communicate the first interior space 150 to the external environment and the apertures 109 may communicate the second interior space 152 to the external environment. The flow of air along the longitudinal axis A-A of the lamp creates a chimney effect that dissipates heat from the LED assembly 130.

Figure 11:
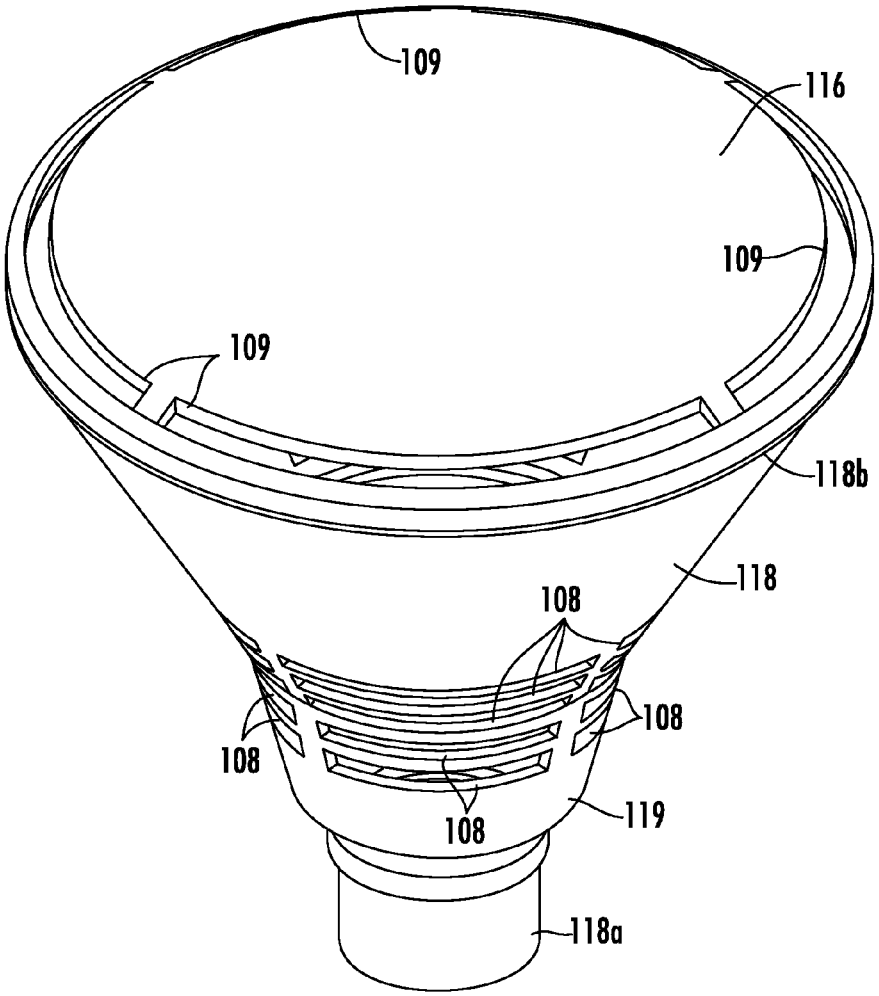
FIGS. 11 and 12 are perspective views of alternate embodiments of the housing used in the lamp of the invention.
Figure 12:
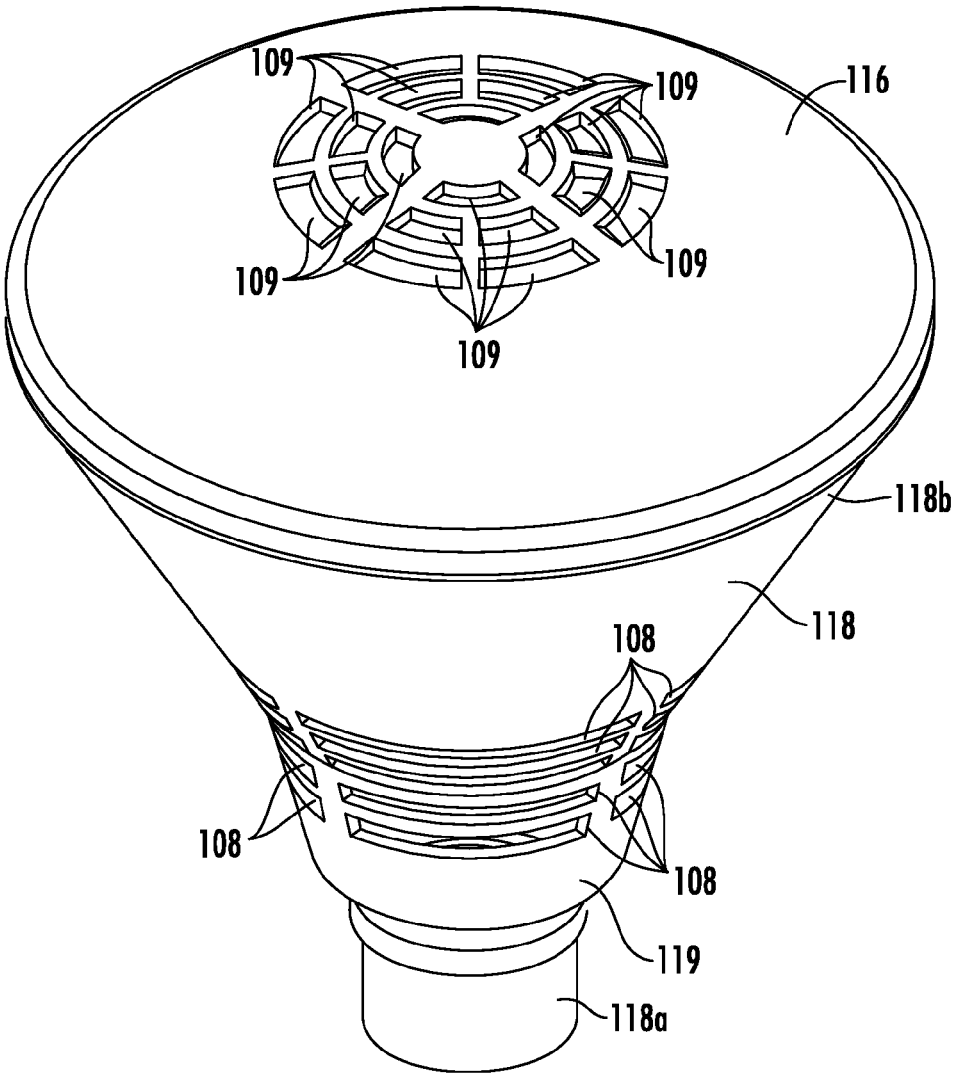

In one embodiment the apertures 109 formed near the distal end 118*b* of the housing 118 are formed in the exit surface 116 as shown in FIGS. 11 and 12. In the embodiment of FIG. 12 the apertures 109 are located in a central portion of the exit surface 116 while in the embodiment of FIG. 11 the apertures 109 are formed along the perimeter edge of the exit surface 116. In the embodiment of FIG. 1 the apertures 109 are formed near the distal end 118*b* of the housing 118 adjacent the exit surface 116.

The apertures 108, 109 may be formed around the perimeter of the enclosure. The apertures may be formed as relatively narrow elongated slots. In some applications it is desirable to prevent a direct line of sight from a person to the LEDs 127. Using relatively narrow elongated slots may be used to prevent a direct line of sight to the LEDs 127. It will be understood that the LEDs 127 may be positioned in the enclosure 112 and the apertures 108 may be configured such that as the angle of observation through the slots 108 changes the dividers 108*a* between the slots 108 block direct line of sight view of the LEDs 127 such that the interior components are blocked from view during normal use and observation of the lamp. In other embodiments translucent or opaque blockers may be formed as part of the enclosure and or LED boards or may be added as inserts inside of the enclosure where the blockers are positioned to block direct line of sight to the LEDs through the apertures 109. Because light emitted from the LEDs 127 strikes the blockers, the blockers may be made of different materials and may have different sizes, shapes and orientations to modify the pattern of light emitted from the lamp. In some embodiments the blocker may be made of diffusive material such as plastic such that the blockers may diffuse and reflect the light in varying amounts. The blockers may be made of a reflective material to reflect the light rather than diffuse the light. The blockers may be planar members arranged substantially parallel the LED board or the blockers may be curved or faceted and may be arranged at varying angles relative to the LED board 129.

The LED board 129 may be arranged in housing 112 to form passages 190 in order to allow air to flow from the first interior space 150 around the LED assembly 130 and into the second interior space 152. This arrangement allows air to flow over both sides of the LED board 129 to efficiently cool the lamp. The passages 190 may be formed between the LED board 129 and the enclosure 112 by extending the LED board 129 less than the width of the enclosure 112 such that the LED board 129 does not extend all of the way to the enclosure 112 over the entire perimeter of the LED board 129. In other embodiments passages may be formed as apertures 192 that extend through the LED board 129. The LED board 129 may comprise a variety of different shapes and sizes and more than one board 129 may be used to form the LED assembly 130 such that the passages may be formed between the boards. The LED board may be configured to match the shape of the interior of the enclosure or the boards may be a simple rectangular, circular or other geometric or random shape that is unrelated to the shape of the interior of the enclosure.

In one embodiment the enclosure 112 and the LED board 129 are formed with mating engagement structures. The enclosure 112 may be formed with a plurality of channels or slots 200 arranged at the desired position of the LED board 129 in the enclosure 112. The LED board 129 is formed with an edge that may comprise mating projections 202 that engage the channels 200 when the LED assembly 130 is positioned in the enclosure 112. In the illustrated embodiment the projections 202 are formed by the corners of the LED board 129. The engagement of the projections 202 with the channels 200 fixes the position of the LED board 129 relative to the enclosure 112 such that the LED board does not move inside of the enclosure. While the male projections are described as being formed on the board 129 and the female channels are formed on the enclosure 112 these components may be reversed such that male members are formed on the enclosure 112 and the female receptacles are formed on the LED board 129. Moreover, the LED board 129 may be attached to the enclosure 112 using other mechanisms such as adhesive or separate connector. For example, the reinforcement member 160 that is used to connect the LED board 129 to the lamp electronics board 111 may comprise the male or female engagement members that engage the mating female or male engagement members on the enclosure 112.

In some embodiments a wireless module 600 may be provided in the bulb for receiving, and/or transmitting, a radio signal or other wireless signal between the lamp and a control system and/or between lamps. The module 600 may convert the radio wave to an electronic signal that may be delivered to the lamp electronics 110 for controlling operation of the lamp. The wireless module 600 may also be used to transmit a signal from the lamp. The wireless module 600 may be positioned inside of the enclosure 112 such that the base 102 including Edison screw 103 do not interfere with signals received by or emitted from wireless module 600. While the wireless module 600 is shown in the enclosure 112 the wireless module 600 may also extend entirely or partially outside of the lamp.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A LED lamp comprising:

an enclosure comprising a non-optically transmissive housing and an optically transmissive exit surface and a base connected to the enclosure defining a longitudinal axis extending from the base to the optically transmissive exit surface, the housing having a generally conically shaped sidewall and being connected to the base at a proximal end and diverging as the housing extends away from the base to a distal end to define an interior cavity, the distal end of the housing defining a maximum lateral width of the enclosure, the optically transmissive exit surface defining an open end that is connected to the distal end of the housing, the open end defining a maximum lateral width of the optically transmissive exit surface where the maximum lateral width of the housing is substantially equal to the maximum lateral width of the optically transmissive exit surface such that the optically transmissive exit surface does not extend laterally beyond the base wherein the enclosure is configured to have the form factor of a BR lamp and where the housing has the shape of a reflector;

a lamp electronics board comprising a first end and a second end, the first end mounted to the base such that the lamp electronics board extends from the base along the longitudinal axis of the enclosure and the second end is disposed adjacent the distal end of the housing such that the interior cavity is substantially open between the distal end and the proximal end;

a LED board positioned in the interior cavity and mounted to the second end of the lamp electronics board such that the LED board is positioned adjacent the distal end of the housing and is oriented transversely to a longitudinal axis of the enclosure and defining a first interior space and a second interior space and a passage communicating the first interior space with the second interior space, the LED board being supported in the housing such that a thermally conductive path is not created between the LED board and an external heat sink;

a LED on the LED board operable to emit light when energized through an electrical path from the base, the LED and LED board being positioned within the housing such that light is emitted primarily directly from the exit surface without being reflected off of the housing;

a first aperture located in the sidewall of the housing and communicating the first interior space with the exterior of the lamp and a second aperture in the sidewall of the housing adjacent the distal end and the optically transmissive exit surface and communicating with the second interior space such that a chimney effect is created where air flows along the longitudinal axis of the lamp around the lamp electronic board and the LED board such that heat is least partially dissipated from the LED board by convection of air in the housing.

2. The LED lamp of claim 1 wherein the lamp electronics board is electrically coupled to the LED board by a spring contact.

3. The LED lamp of claim 2 further comprising a reinforcement member, the reinforcement member comprising a first channel for retaining the LED board and a second channel for receiving the lamp electronics board.

4. The LED lamp of claim 3 wherein the spring contact is on the reinforcement member.

5. The LED lamp of claim 3 wherein the reinforcement member comprises an aperture for receiving the spring contact.

6. The LED lamp of claim 1 wherein the housing has an outer surface where the outer surface has a polished finish.

7. The LED lamp of claim 6 wherein the outer surface has a surface texture of VDI24.

8. The LED lamp of claim 1 wherein the first aperture is positioned adjacent the base.

9. The LED lamp of claim 1 wherein the LED board is thermally dissipative.

10. The LED lamp of claim 1 wherein the LED board is electrically conductive and forms a part of the electrical path.

11. The LED lamp of claim 1 wherein one of the LED board and the lamp electronics board comprises a slot that receives a tab on the other one of the LED board and the lamp electronics board.

12. The LED lamp of claim 1 wherein one of the LED board and the enclosure comprises a channel that receives a projection on the other one of the LED board and the enclosure to fix the position of the LED board relative to the enclosure.

13. A LED lamp comprising:

an enclosure comprising a housing and an optically transmissive exit surface and a base connected to the enclosure defining a longitudinal axis extending from the base to the optically transmissive exit surface, the housing having a generally conically shaped sidewall and extending from the base where the housing diverges as the housing extends away from the base to a distal end, the distal end of the housing defining a maximum lateral width of the enclosure, the optically transmissive exit surface defining an open end that is connected to the distal end of the housing, the open end defining a maximum lateral width of the optically transmissive exit surface where the maximum lateral width of the housing is substantially equal to the maximum lateral width of the optically transmissive exit surface such that the optically transmissive exit surface does not extend laterally beyond the base wherein the enclosure is configured to have the form factor of a BR lamp;

a lamp electronics board comprising a first end and a second end, the first end mounted to the base such that the lamp electronics board extends from the base along the longitudinal axis of the enclosure and the second end is disposed adjacent the distal end of the housing such that the interior cavity is substantially open between the distal end and the proximal end;

a LED board mounted to the second end of the lamp electronics board such that the LED board is positioned adjacent the distal end of the housing defining a first interior space and a second interior space between the LED board and the exit surface and a passage communicating the first interior space with the second interior space, the LED board being supported in the housing such that a thermally conductive path is not created between the LED board and an external heat sink, the LED board comprising a thermally conductive material for dissipating heat to air inside of the enclosure by convection;

a LED on the LED board operable to emit light when energized through an electrical path from the base, the LED and LED board being positioned within the housing such that light is emitted primarily directly from the exit surface without being reflected off of the housing;

a first aperture located in the sidewall of the housing and communicating the first interior space with the exterior of the lamp and a second aperture communicating the second interior space with the exterior of the lamp, the second aperture being in the optically transmissive exit surface such that a chimney effect is created where air flows over and around the LED board and the lamp electronic board such that heat is dissipated from the LEDs at least partially by convection of air in the housing without use of an external heat sink.

14. The LED lamp of claim 13 wherein the second aperture is positioned at a center of the exit surface.

15. The LED lamp of claim 13 wherein the second aperture is positioned at a periphery of the exit surface.

16. The LED lamp of claim 13 wherein the LED board is electrically conductive and forms a part of the electrical path.

17. The LED lamp of claim 13 the lamp electronics board is electrically coupled to the LED board by a spring contact.

* * * * *